US007428388B2

(12) United States Patent
Aoki et al.

(10) Patent No.: US 7,428,388 B2
(45) Date of Patent: Sep. 23, 2008

(54) IMAGE FORMATION APPARATUS WITH IMAGE CORRECTION CAPABILITY

(75) Inventors: Matsuyuki Aoki, Kanagawa (JP); Satoshi Tanaka, Kanagawa (JP); Akira Ishii, Kanagawa (JP); Hiroshi Ono, Kanagawa (JP); Hideki Kashimura, Kanagawa (JP); Kohei Shioya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 51 days.

(21) Appl. No.: 11/494,602

(22) Filed: Jul. 28, 2006

(65) Prior Publication Data

US 2007/0196118 A1 Aug. 23, 2007

(30) Foreign Application Priority Data

Feb. 21, 2006 (JP) ..... 2006-044196

(51) Int. Cl.
*G03G 15/00* (2006.01)
*G03G 21/00* (2006.01)

(52) U.S. Cl. ..... 399/48; 399/128

(58) Field of Classification Search ..... 399/48, 399/51, 127, 128; 347/133
See application file for complete search history.

(56) References Cited

U.S. PATENT DOCUMENTS 4,621,920 A * 11/1986 Takahashi ..... 399/128
4,827,306 A * 5/1989 Tsujimoto et al. ..... 399/128
5,565,963 A * 10/1996 Tsujita et al. ..... 399/48
6,070,032 A * 5/2000 Rokutanda et al. ..... 399/128

FOREIGN PATENT DOCUMENTS

| | | | |
|---|---|---|---|
| JP | A-08-030145 | | 2/1996 |
| JP | A-11-112810 | | 4/1999 |
| JP | A-2000-056522 | | 2/2000 |
| JP | 2003-182149 | * | 7/2003 |
| JP | A-2003-182149 | | 7/2003 |

* cited by examiner

*Primary Examiner*—Sandra L Brase
(74) *Attorney, Agent, or Firm*—Morgan, Lewis & Bockius LLP

(57) ABSTRACT

An image formation apparatus includes an imaging light source, a photosensitive body and a correction light source. The imaging light source outputs light modulated in accordance with image data representing an image. An electrostatic latent image is formed at the photosensitive body by the light output from the imaging light source. The correction light source is provided separately from the imaging light source, and outputs light toward the photosensitive body for correcting one of variations in potential on the photosensitive body and irregularities in density distribution of an image, which image is to be formed in accordance with the electrostatic latent image that is formed on the photosensitive body by the imaging light source.

16 Claims, 10 Drawing Sheets

IMAGE FORMATION APPARATUS WITH IMAGE CORRECTION CAPABILITY

BACKGROUND

1. Technical Field

The present invention relates to an image formation apparatus, and more particularly relates to an image formation apparatus which exposes light onto a photosensitive body and forms an electrostatic latent image.

2. Related Art

In an electrophotography-type image formation apparatus, which exposes a photosensitive body surface to form a latent image, density variations within a page (within an image on the page) are caused by various factors. For example, variations in photosensitivity of the photosensitive body, charging variations, variations in exposure amounts, variations in distance between the photosensitive body and a developing sleeve, transfer variations and so forth can be mentioned as such factors.

Various techniques have been proposed as techniques for correcting the density irregularities caused by these factors.

For example, there are: (1) a technique of correcting density irregularities with image data; (2) a technique of prememorizing photosensitive body characteristics of a photosensitive body, comparing therewith photosensitive body characteristics subject to the effects of the passage of time, which is an amount of time of use of the photosensitive body, temperature and humidity of the vicinity of the photosensitive body, a number of sheets printed and the like, measuring density irregularities, and correcting one or more of charging quantities, exposure quantities, development quantities and transfer quantities; (3) a technique of correcting exposure amounts in accordance with an average value and variations of latent image potential over a full turn of a photosensitive body; and so forth.

A technique (4) of separately using exposure amounts that are required for controlling image density and exposure amounts that are for correcting page density irregularities has also been proposed.

SUMMARY

An aspect of the present invention is an image formation apparatus including an imaging light source that outputs light modulated in accordance with image data representing an image, a photosensitive body at which an electrostatic latent image is formed by the light output from the imaging light source, and a correction light source that is provided separately from the imaging light source, and that outputs light toward the photosensitive body to correct variations in potential on the photosensitive body or irregularities in density distribution of an image, the image being formed in accordance with the electrostatic latent image that is formed on the photosensitive body by the imaging light source.

BRIEF DESCRIPTION OF THE DRAWINGS

Exemplary embodiments of the present invention will be described in detail based on the following figures, wherein.

DETAILED DESCRIPTION

Herebelow, examples of embodiments of the present invention will be described in detail with reference to the drawings.

First Exemplary Embodiment

Figure 1:
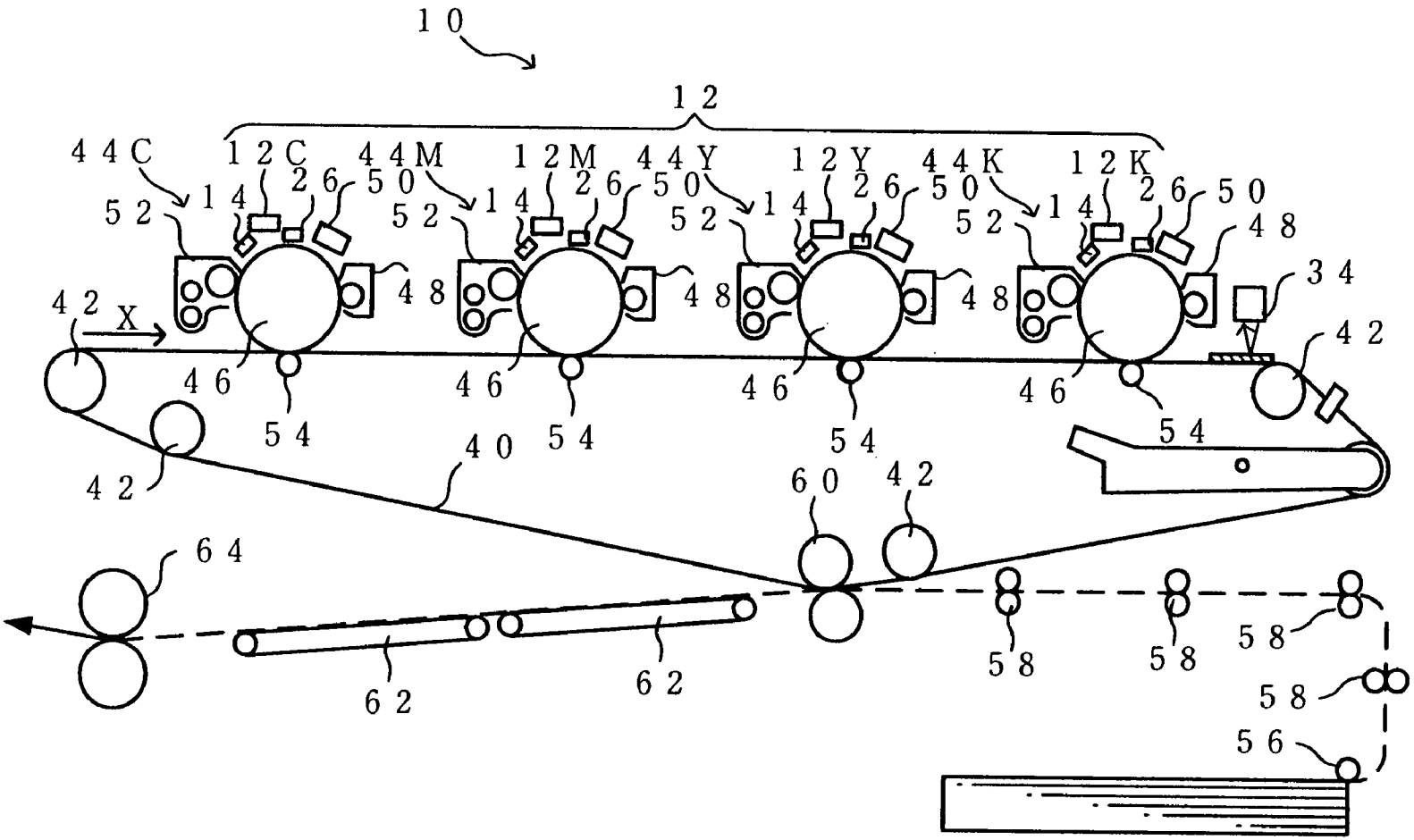
FIG. 1 is a diagram showing schematic structure of a tandem color printer which is useable for an image formation apparatus relating to a first exemplary embodiment of the present invention.

FIG. 1 is a diagram showing general structure of a tandem color printer which is useable for an image formation apparatus relating to a first exemplary embodiment of the present invention.

As is shown in FIG. 1, in a tandem color printer 10, an intermediate transfer belt 40 formed of an endless belt is supported with a predetermined tension applied thereto by plural rollers 42. Over the intermediate transfer belt 40, image recording units 44C, 44M, 44Y and 44K, corresponding to the colors cyan (C), magenta (M), yellow (Y) and black (K), respectively, are arranged in this order along a running direction X of the belt. For the following descriptions, except where particularly specified, each image recording unit has the same structure, and the descriptions are given with the reference letters corresponding to the respective colors being omitted.

Each image recording unit 44 includes a respective photosensitive drum 46, which is axially supported, to be rotatable, at an unillustrated device main body frame. At the periphery of each photosensitive drum 46, a cleaner 48, an erasure lamp (not shown), a charger 50, a laser scanning. device 12 (12C, 12M, 12Y and 12K, corresponding to the colors cyan (C), magenta (M), yellow (Y) and black (K), respectively), a development unit 52 and a primary transfer roller 54 are arranged in this order along a direction of rotation of the drum (i.e., an anti-clockwise direction of FIG. 1).

That is, after toner remaining on the photosensitive drum 46 has been removed by the cleaner 48, electric charge on the photosensitive body is eliminated by the charge-removing erasure lamp, charging is performed by the charger 50, and light is irradiated at the surface of the photosensitive drum 46 by the laser scanning device 12 to form a latent image. Then, the latent image formed by the laser scanning device 12 is formed into a toner image by the development unit 52, and is transferred to the intermediate transfer belt 40 by the primary transfer roller 54. Here, sub-scanning is implemented by the photosensitive drum 46 and main scanning is implemented by the laser scanning device 12.

A potential sensor 14 is provided between the laser scanning device 12 and the development unit 52. The potential sensor 14 detects a distribution of electric potential of the photosensitive drum 46 when a pre-specified intra-page density irregularity correction pattern, for measurement of density irregularities of the photosensitive drum 46, is formed. Correction of intra-page irregularities is implemented on the basis of detection results from the potential sensor 14.

Further, a patch density detection sensor 34 is disposed at a downstream side, in the belt running direction X, of the image recording unit 44K for black (K). The patch density detection sensor 34 senses densities of a toner image formed on the intermediate transfer belt 40 for the respective color C, M, Y or K, and detects a density distribution (intra-page density variations) of the photosensitive drum 46. The patch density detection sensor 34 is structured by a reflection-type photosensor.

Paper, which is an object of image recording, is accommodated at an unillustrated paper cassette. The paper is fed out by a pickup roller 56, which is disposed at a paper feeding side of the paper cassette. The paper that is fed out is conveyed along a path shown by a broken line in the drawing by rollers 58 and is fed to a position of abutting of a secondary transfer roller 60, and the color image on the intermediate transfer belt 40 is transferred in a single transfer to the paper (secondary transfer). The paper to which the color image has been transferred is conveyed to a fixing unit 64 by a paper conveyance system 62, fixing processing (heating, pressing or the like) of the image is implemented at the fixing unit 64, and then the paper is ejected to an unillustrated tray.

Figure 2:
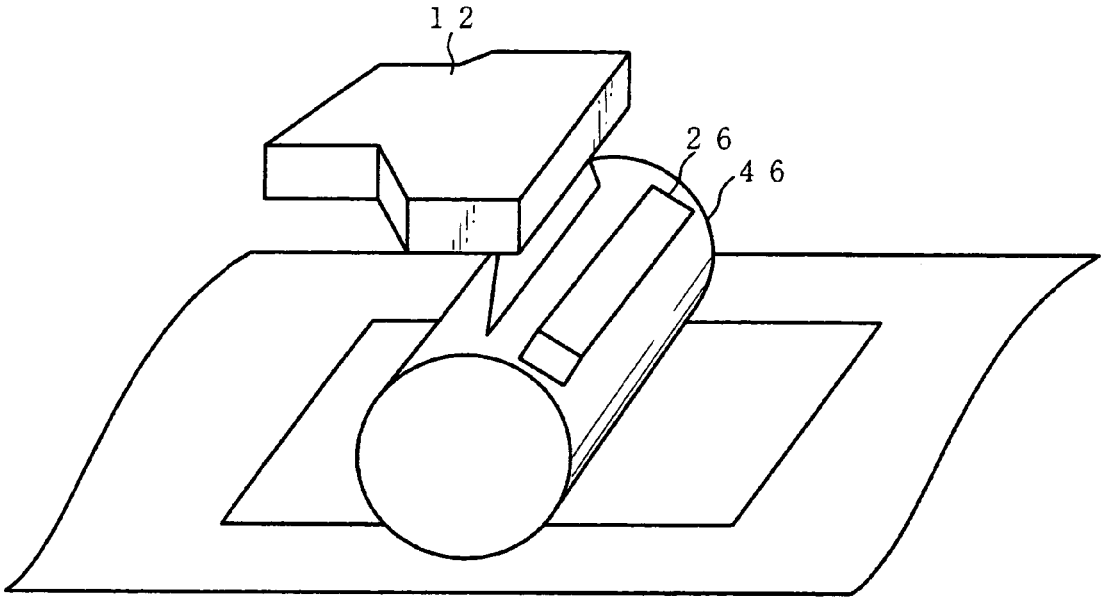
FIG. 2 is a diagram for describing a light source for correction of intra-page density irregularities, in the tandem color printer relating to the first exemplary embodiment.

As shown in FIGS. 1 and 2, the tandem color printer of this exemplary embodiment is provided with a correction light source 26, for correcting intra-page density irregularities, between the charger 50 and the laser scanning device 12 at the periphery of the photosensitive drum 46. At the correction light source 26, plural LEDs are arranged along the main scanning direction. Intra-page density irregularities in the main scanning direction and the sub-scanning direction are corrected to substantially uniformity by control of illumination of the plural LEDs.

A spot diameter of light which is output from the correction light source 26 and focused onto the photosensitive drum 46 may be different from a spot diameter of light which is output from the laser scanning device 12 and focused onto the photosensitive drum 46, or the spot diameters may be the same. In a case in which the spot diameters are set to be different, if the spot diameter of the correction light source 26 is set smaller than the spot diameter of the light that is output from the laser scanning device 12 and focused onto the photosensitive drum 46, a resolution of correction will be high (such that finely detailed correction is possible). On the other hand, if the spot diameter of the correction light source 26 is set larger than the spot diameter of the light that is output from the laser scanning device 12 and focused onto the photosensitive drum 46, correction is possible with a smaller number of lines, and thus an exposure amount map which is used for correction can be simplified.

Herein, the correction light source 26 may correct potentials or density variations of the photosensitive drum 46 in a continuous or stepwise manner over each full turn of the photosensitive drum 46.

Figure 3:
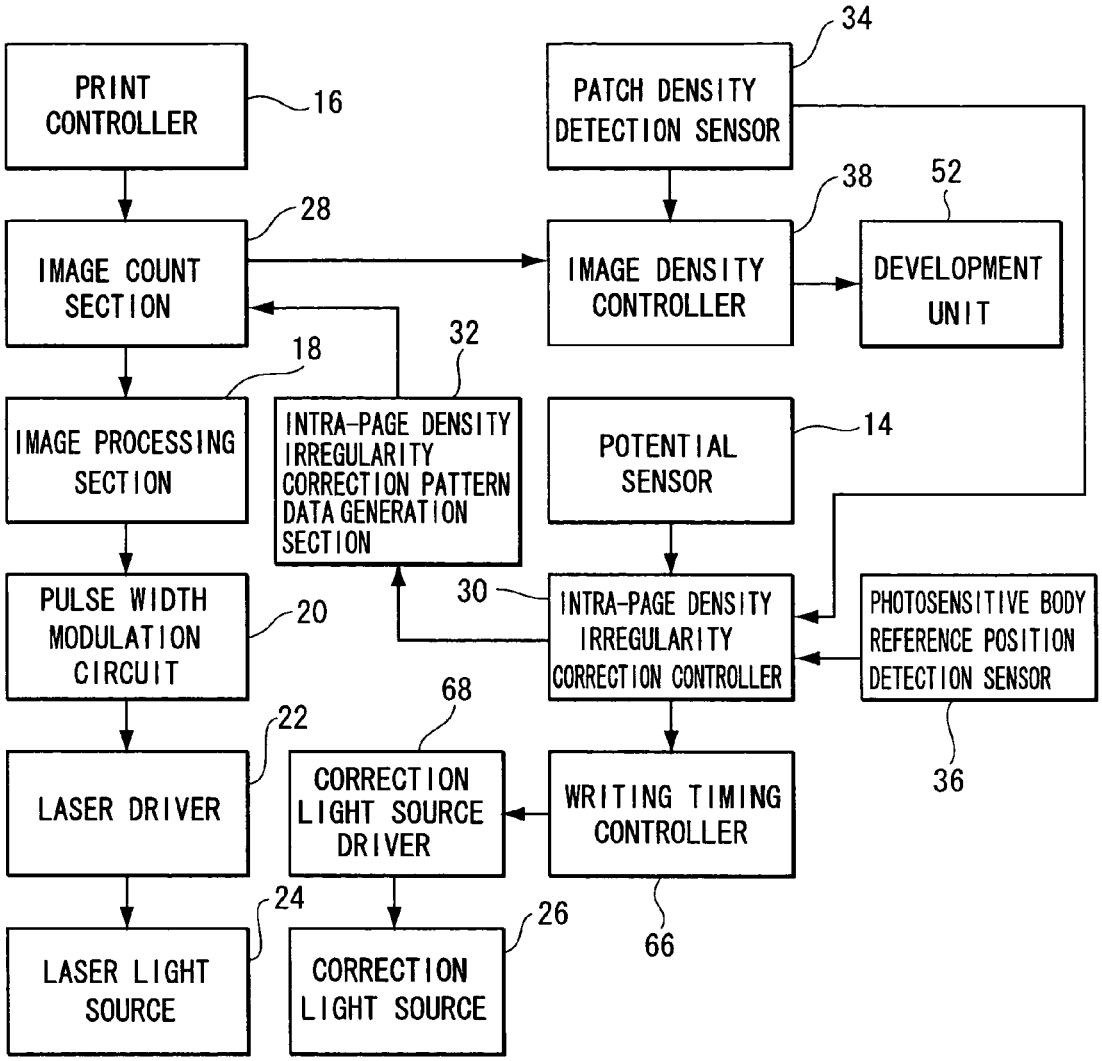
FIG. 3 is a block diagram showing structure of a control system of the tandem color printer relating to the first exemplary embodiment.

Next, structure of a control system of the tandem color printer 10 relating to the first exemplary embodiment of the present invention will be described. FIG. 3 is a block diagram showing structure of the control system of the tandem color printer 10.

In the tandem color printer 10 relating to this exemplary embodiment, overall control is performed by a print controller 16. Image data for image formation is inputted to the print controller 16.

The tandem color printer 10 is also equipped with an image processing section 18, a pulse width modulation circuit 20, a laser driver 22 and a laser light source 24. Image formation onto the photosensitive drum 46 is implemented by these components.

When image data is inputted to the print controller 16, the image data is output to the image processing section 18, via an image count section 28, and predetermined image processing is performed, after which the image data is output to the pulse width modulation circuit 20.

At the pulse width modulation circuit 20, modulation data is generated, for emission of light modulated in accordance with the image data, and is output to the laser driver 22.

The laser driver 22 drives the laser light source 24 to perform scanning exposure onto the photosensitive drum 46 in accordance with the modulation data. Accordingly, scanning exposure in the main scanning direction is implemented on the photosensitive drum 46, sub-scanning is implemented by rotation of the photosensitive drum 46, and an image is formed on the photosensitive drum 46.

The tandem color printer 10 relating to this exemplary embodiment is also equipped with the image count section 28, an image density controller 38 and the patch density detection sensor 34, for controlling a development density at the development unit 52. For the image data output from the print controller 16, an image data quantity is counted by the image count section 28 and a result of counting is output to the image density controller 38. For example, the image count section 28 calculates a number of signals in the image which are effective for image formation as an image data quantity, and outputs calculation results to the image density controller 38.

The patch density detection sensor 34 detects densities of the pre-specified patch image, which is formed at predetermined times, outputs detection results to the image count section 28, and also outputs the same to an intra-page density irregularity correction controller 30, which will be described below.

The image density controller 38 controls a supply of toner in the development unit 52 on the basis of the image data quantity calculation results from the image count section 28 and the detection results from the patch density detection sensor 34, so as to keep toner density uniform.

The tandem color printer 10 relating to this exemplary embodiment is also equipped with the intra-page density irregularity correction controller 30. Correction of density irregularities within a page (intra-page density irregularities) which is image-formed is implemented by the intra-page density irregularity correction controller 30.

For the correction of intra-page density irregularities, an intra-page density irregularity correction pattern may be formed on the photosensitive drum 46 at a predetermined time and a density distribution of the intra-page density irregularity correction pattern detected, or potentials of the photosensitive drum 46 that has been charged by the charger 50 at a time of image formation may be detected.

When the intra-page density irregularity correction pattern is to be formed, the intra-page density irregularity correction pattern is generated by an intra-page density irregularity correction pattern data generation section 32 and, similarly to image data as described above, is output to the image processing section 18 via the image count section 28 and subjected to the predetermined image processing. Then, the data is output to the pulse width modulation circuit 20, and modulation data is generated for emitting light modulated in accordance with the pattern data, and is output to the laser driver 22. Hence, the intra-page density irregularity correction pattern is formed on the photosensitive drum 46. Herein, the intra-page density irregularity correction pattern is a pattern with which density variations can be detected over a full turn of the photosensitive drum 46. A respective intra-page density irregularity correction pattern is formed on each photosensitive drum 46.

The intra-page density irregularity correction controller 30 is connected with the aforementioned patch density detection sensor 34, the potential sensor 14 and a photosensitive body reference position detection sensor 36. For the photosensitive body reference position detection sensor 36 herein, for example, a rotary encoder or the like can be provided at a rotation axis of the photosensitive drum 46. Further, a notch portion or the like can be provided at a region of the rotary encoder corresponding to a reference position of the photosensitive drum 46, and the reference position of the photosensitive drum 46 can be detected by detecting the notch portion. Alternatively, a mark or the like can be provided at a location, of a portion of the photosensitive drum 46 which will not affect image formation, corresponding to the reference position of the photosensitive drum 46, and the reference position of the photosensitive drum 46 can be detected by detecting the mark. Hence, because the photosensitive drum 46 is continuous over a full turn (the surface thereof is continuous over a full-turn unit when the photosensitive drum 46 turns), start point and end point positions of the photosensitive drum 46 can be detected by the photosensitive body reference position detection sensor 36.

With reference to the pre-specified reference position of the photosensitive drum 46 which is detected by the photosensitive body reference position detection sensor 36, the intra-page density irregularity correction controller 30 calculates a density irregularity distribution from densities of the intra-page density irregularity correction pattern formed on the photosensitive drum 46, which are detected by the patch density detection sensor 34, or from potentials of the photosensitive drum 46 which are detected by the potential sensor 14. Then, from the density irregularity distribution, the intra-page density irregularity correction controller 30 calculates correction amounts for correcting irregularities in exposure amounts corresponding to the intra-page density irregularities (an exposure amount correction map), and outputs the calculation results to a writing timing controller 66. Hence, the writing timing controller 66 controls a correction light source driver 68, illuminates the correction light source 26 with timings referred to the reference position detected by the photosensitive body reference position detection sensor 36, and corrects the exposure amount irregularities. Here, in order to correct the intra-page density irregularities with the correction light source 26, the exposure amount correction map can correct intra-page density irregularities by, for example, the exposure amount correction map being created such that portions at which the densities of the density irregularity distribution are denser are made to match other portions. The correction of exposure amount irregularities is performed for each of the image recording units 44.

Next, intra-page density irregularity correction processing which is performed at the tandem color printer 10, which is structured as described above, will be described.

Figure 4:
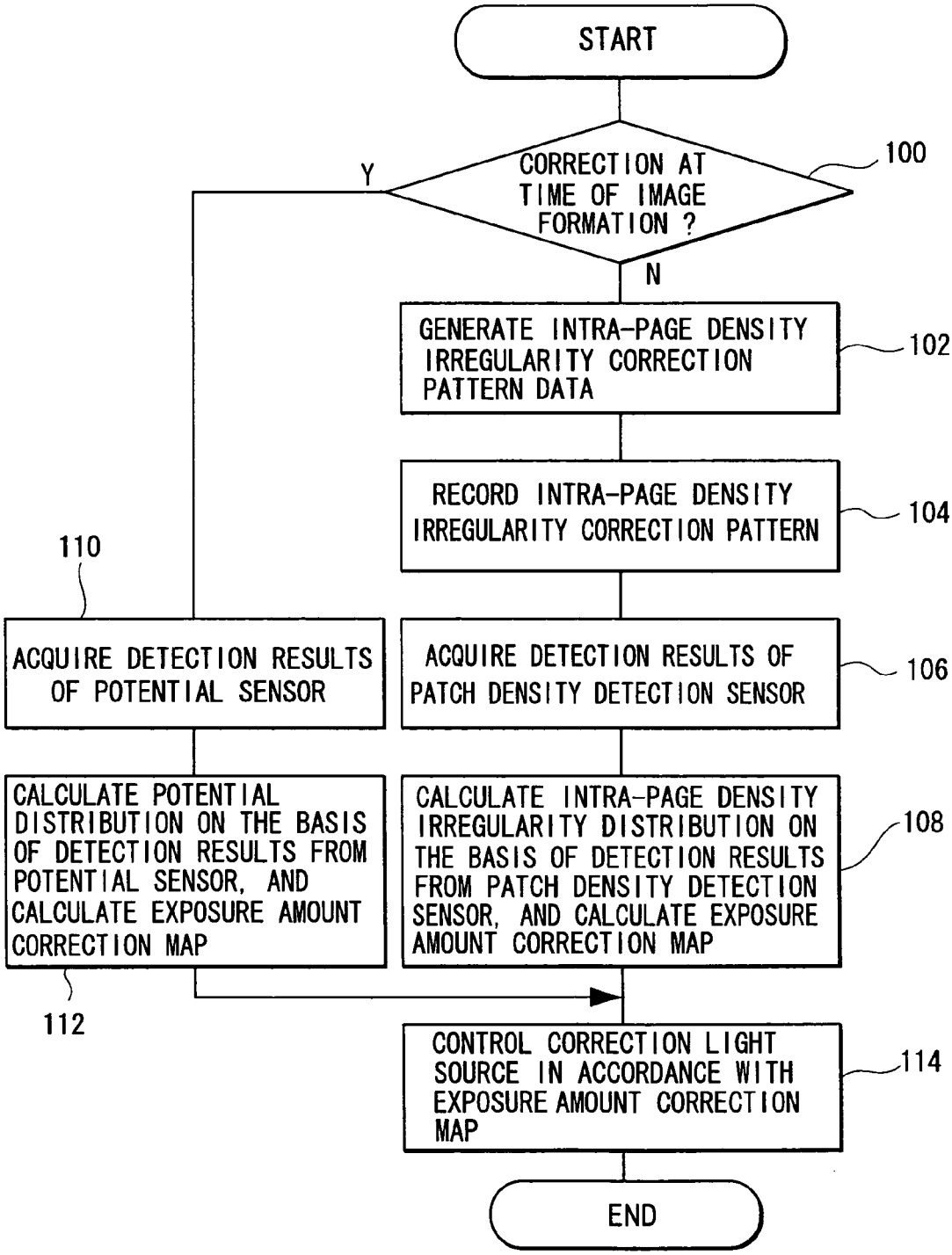
FIG. 4 is a flowchart showing an example of flow of intra-page density irregularity correction processing, which is performed by the tandem color printer relating to the first exemplary embodiment.

FIG. 4 is a flowchart showing an example of flow of the intra-page density irregularity correction processing, which is performed by the tandem color printer 10 relating to the first exemplary embodiment.

Firstly, in step 100, it is judged by the intra-page density irregularity correction controller 30 whether or not to carry out correction at a time of image formation. If intra-page density irregularity correction is to be carried out at a time of image formation, this judgment is positive and the process advances to step 110. If correction is to be performed other than at a time of image formation, for example, when a power supply is switched on, during initialization or the like, the judgment is negative and the processing advances to step 102.

In step 102, intra-page density irregularity correction pattern data is generated by the intra-page density irregularity correction pattern data generation section 32, and the processing advances to step 104.

In step 104, the intra-page density irregularity correction pattern data generated in step 102 is recorded. That is, the intra-page density irregularity correction pattern data generated in step 102 is output to the image processing section 18 via the image count section 28 and is subjected to the predetermined image processing. Thereafter, the data is output to the pulse width modulation circuit 20, and modulation data for emitting light modulated in accordance with the image data is generated and output to the laser driver 22. Hence, the intra-page density irregularity correction pattern is formed on the photosensitive drum 46 and transferred onto the intermediate transfer belt 40.

Next, in step 106, detection results from the patch density detection sensor 34 are acquired by the intra-page density irregularity correction controller 30, and the processing advances to step 108. That is, densities of the intra-page density irregularity correction pattern that has been formed on the intermediate transfer belt 40 are detected by the patch density detection sensor 34 and are acquired by the intra-page density irregularity correction controller 30.

In step 108, a density distribution (intra-page density irregularity distribution) is calculated by the intra-page density irregularity correction controller 30 on the basis of the detection results from the patch density detection sensor 34. An exposure amount correction map is calculated from the intra-page density irregularity distribution, and the processing advances to step 114.

On the other hand, if the judgment of step 100 is positive and the processing advances to step 110, detection results from the potential sensor 14 are acquired by the intra-page density irregularity correction controller 30, and the processing advances to step 112. That is, electrical potentials of the photosensitive drum 46 are detected by the potential sensor 14 and are acquired by the intra-page density irregularity correction controller 30.

In step 112, a distribution of potentials on the photosensitive drum 46 is calculated by the intra-page density irregularity correction controller 30 on the basis of the detection results from the potential sensor 14. An exposure amount correction map is calculated from the potential distribution, and the processing advances to step 114.

Then, in step 114, the correction light source 26 is controlled in accordance with the exposure amount correction map, and the sequence of processing ends. That is, the correction light source driver 68 is controlled by the writing timing controller 66, and illumination of the correction light source 26 is controlled in accordance with the exposure amount correction map, with timings referred to the reference position detected by the photosensitive body reference position detection sensor 36. Thus, potentials on the photosensitive drum 46 are corrected so as to be substantially uniform, and density irregularities within a page are compensated for. Furthermore, in a case in which the correction of intra-page density irregularities is performed at a time of image formation, because the photosensitive drum 46 is continuous over a full turn, it is possible to perform corrections with continuity, with the reference position detected by the photosensitive body reference position detection sensor 36 serving as a reference point.

In this exemplary embodiment formed thus, the light source for image formation and the light source for intra-page density irregularity correction are separately provided. Moreover, in this exemplary embodiment, it is possible to use a surface light-emission device which is equipped with plural light-emitting elements or the like as the light source for image formation.

Second Exemplary Embodiment

Next, a tandem color printer relating to a second exemplary embodiment of the present invention will be described.

In the first exemplary embodiment, the dedicated correction light source 26 is provided for compensating for intra-page density irregularities, such that the intra-page density irregularities are corrected. The second exemplary embodiment, however, is a structure in which an erasure lamp is used as a light source for correction and carries out correction of intra-page density irregularities. Other structures are the same as in the first exemplary embodiment. Therefore, only differences will be described.

Figure 5:
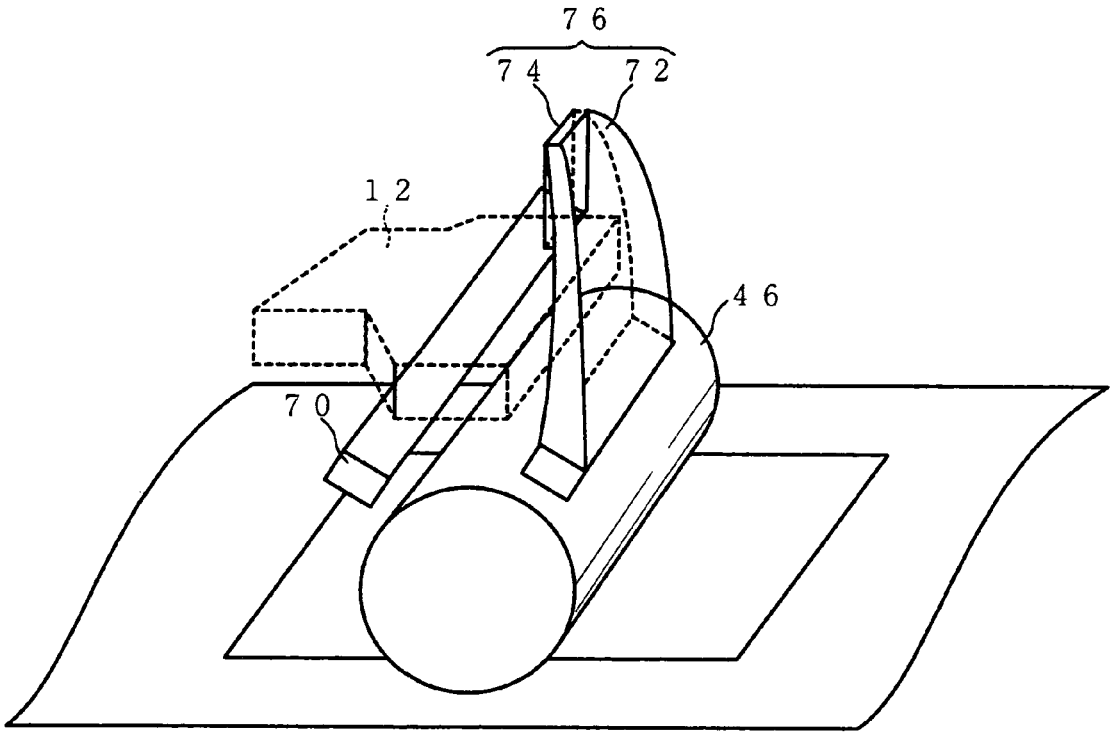
FIG. 5 is a diagram for describing a light source for correction of intra-page density irregularities, in a tandem color printer relating to a second exemplary embodiment of the present invention.

FIG. 5 is a diagram for describing the light source for correction of intra-page density irregularities in the tandem color printer relating to the second exemplary embodiment of the present invention.

The present exemplary embodiment utilizes an erasure lamp 70 as the correction light source. As the erasure lamp 70, for example, a lamp at which plural LEDs are arranged in the main scanning direction of the photosensitive drum 46 is used. Among the plural LEDs of the erasure lamp 70, LEDs in a range outside an image formation range and/or a range which will not affect image formation are used to perform intra-page density irregularity correction.

More specifically, light which is output from the LEDs of the erasure lamp 70 is propagated, to serve as the correction light source, by an optical sheet bus apparatus 76, which is provided with an optical sheet bus 72 and a variable light amount portion 74. The variable light amount portion 74 alters light amounts of light to be propagated into the optical sheet bus 72.

The optical sheet bus 72, by diffusingly propagating the light along a sheet-form light propagation path, can transmit the light to plural propagation destinations. That is, if the light of some (for example, six) LEDs of the plural LEDs of the erasure lamp 70 is transmitted to plural propagation destinations by the optical sheet bus 72, it is possible to cover the main scanning direction width of the photosensitive drum 46 with just a few LEDs, and it is possible to utilize these few LEDs of the erasure lamp 70 as the correction light source.

Further, by controlling light amounts of light to be inputted to the optical sheet bus 72 with the variable light amount portion 74, it is possible to irradiate the light of the erasure lamp 70 onto the photosensitive drum 46 in accordance with the intra-page density irregularity distribution. For example, by the variable light amount portion 74 arbitrarily reducing light that is output from the erasure lamp 70, the erasure lamp 70 can be used as the correction light source.

Thus, the erasure lamp 70 and the optical sheet bus apparatus 76 are used in place of the correction light source 26 of the first exemplary embodiment, and instead of the correction light source driver 68, control for altering light amounts is implemented by the variable light amount portion 74. Hence, similarly to the first exemplary embodiment, it is possible to perform correction of intra-page density irregularities.

Figure 6:
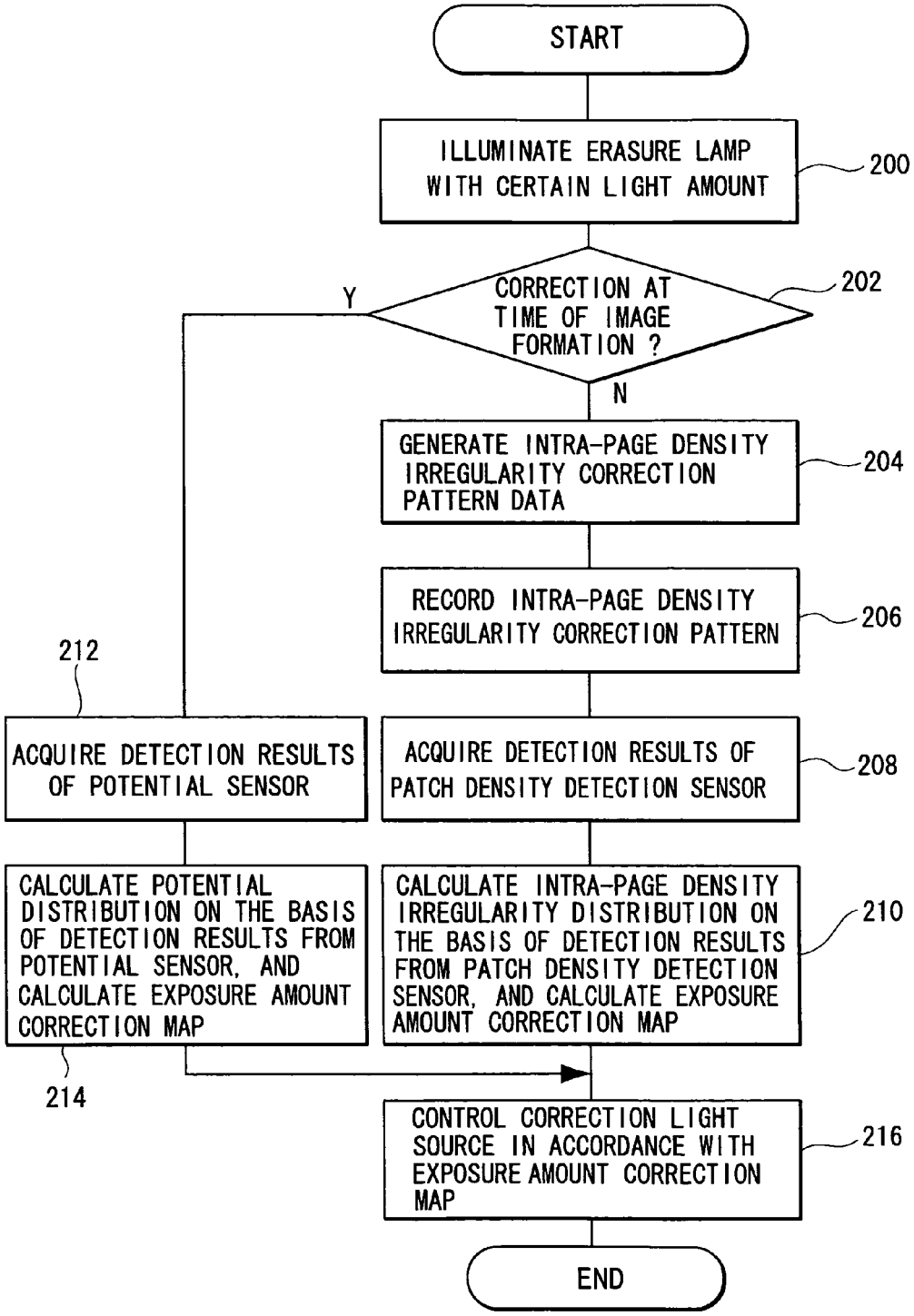
FIG. 6 is a flowchart showing an example of flow of intra-page density irregularity correction processing, which is performed by the tandem color printer relating to the second exemplary embodiment.

FIG. 6 is a flowchart showing an example of flow of intra-page density irregularity correction processing, which is performed by the tandem color printer relating to the second exemplary embodiment.

Firstly, in step 200, the erasure lamp 70 is illuminated with a certain light amount, removal of charge on the photosensitive drum 46 is commenced, and the processing advances to step 202.

In step 202, it is judged by the intra-page density irregularity correction controller 30 whether or not correction is to be carried out at a time of image formation. If intra-page density irregularity correction is to be carried out at a time of image formation, this judgment is positive and the process advances to step 212. If correction is to be performed other than at a time of image formation, for example, when a power supply is switched on, during initialization or the like, the judgment is negative and the processing advances to step 204.

In step 204, intra-page density irregularity correction pattern data is generated by the intra-page density irregularity correction pattern data generation section 32, and the processing advances to step 206.

In step 206, the intra-page density irregularity correction pattern data generated in step 204 is recorded. That is, the intra-page density irregularity correction pattern data generated in step 204 is output to the image processing section 18 via the image count section 28 and is subjected to the predetermined image processing. Thereafter, the data is output to the pulse width modulation circuit 20, and modulation data for emitting light modulated in accordance with the pattern data is generated and output to the laser driver 22. Hence, the intra-page density irregularity correction pattern is formed on the photosensitive drum 46 and transferred onto the intermediate transfer belt 40.

Next, in step 208, detection results from the patch density detection sensor 34 are acquired by the intra-page density irregularity correction controller 30, and the processing advances to step 210. That is, densities of the intra-page density irregularity correction pattern that has been formed on the photosensitive drum 46 are detected by the patch density detection sensor 34 and are acquired by the intra-page density irregularity correction controller 30.

In step 210, a density distribution (intra-page density irregularity distribution) is calculated by the intra-page density irregularity correction controller 30 on the basis of the detection results from the patch density detection sensor 34. An exposure amount correction map is calculated from the intra-page density irregularity distribution, and the processing advances to step 216.

On the other hand, if the judgment of step 202 is positive and the processing advances to step 212, detection results from the potential sensor 14 are acquired by the intra-page density irregularity correction controller 30, and the processing advances to step 214. That is, potentials of the photosensitive drum 46 are detected by the potential sensor 14 and are acquired by the intra-page density irregularity correction controller 30.

In step 214, a distribution of potentials is calculated by the intra-page density irregularity correction controller 30 on the basis of the detection results from the potential sensor 14. An exposure amount correction map is calculated from the potential distribution, and the processing advances to step 216.

Then, in step 216, the variable light amount portion 74 is controlled in accordance with the exposure amount correction map, and the sequence of processing ends. That is, the variable light amount portion 74 is controlled by the writing timing controller 66, the variable light amount portion 74 being controlled in accordance with the exposure amount correction map, with timings referred to the reference position detected by the photosensitive body reference position detection sensor 36. Thus, potentials on the photosensitive drum 46 are corrected so as to be substantially uniform by the light irradiated at the photosensitive drum 46 from the LEDs of the erasure lamp 70, and density irregularities within a page are corrected. Furthermore, in a case in which the correction of intra-page density irregularities is performed at a time of image formation, because the photosensitive drum 46 is continuous over a full turn, it is possible to perform corrections with continuity, with the reference position detected by the photosensitive body reference position detection sensor 36 serving as a reference point.

In this exemplary embodiment formed thus, similarly to the first exemplary embodiment, the light source for image formation and the light source for intra-page density irregularity correction are separately provided.

Moreover, also in this exemplary embodiment too, it is possible to use a surface light-emission device which is equipped with plural light-emitting elements or the like as the light source for image formation. Rather than using a portion of the light-emitting elements of a surface light-emission device to emit light, the separately provided erasure lamp 70 and optical sheet bus apparatus 76 serving as the correction light source are used to correct intra-page density irregularities.

Further yet, in this exemplary embodiment, the LEDs of the erasure lamp 70 are used so as to correct the intra-page density irregularities.

Third Exemplary Embodiment

Next, a tandem color printer relating to a third exemplary embodiment of the present invention will be described.

In the first exemplary embodiment, the correction light source 26 is disposed at the periphery of the photosensitive drum 46, and in the second exemplary embodiment, the erasure lamp 70 and optical sheet bus apparatus 76 are used to perform intra-page density irregularity correction. The third exemplary embodiment, however, is a structure in which a light source for performing correction of intra-page density irregularities is provided inside the laser scanning device 12. Other structures are the same as in the first exemplary embodiment. Therefore, only differences will be described.

Figure 7B:
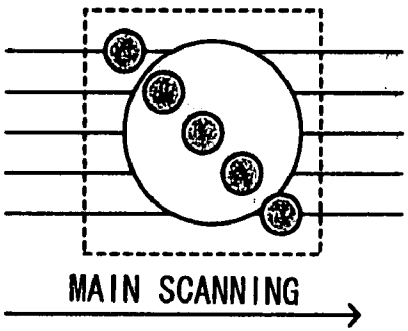
FIGS. 7A and 7B are views showing structure of an optical system in a laser scanning apparatus relating to a third exemplary embodiment of the present invention.
Figure 7A:
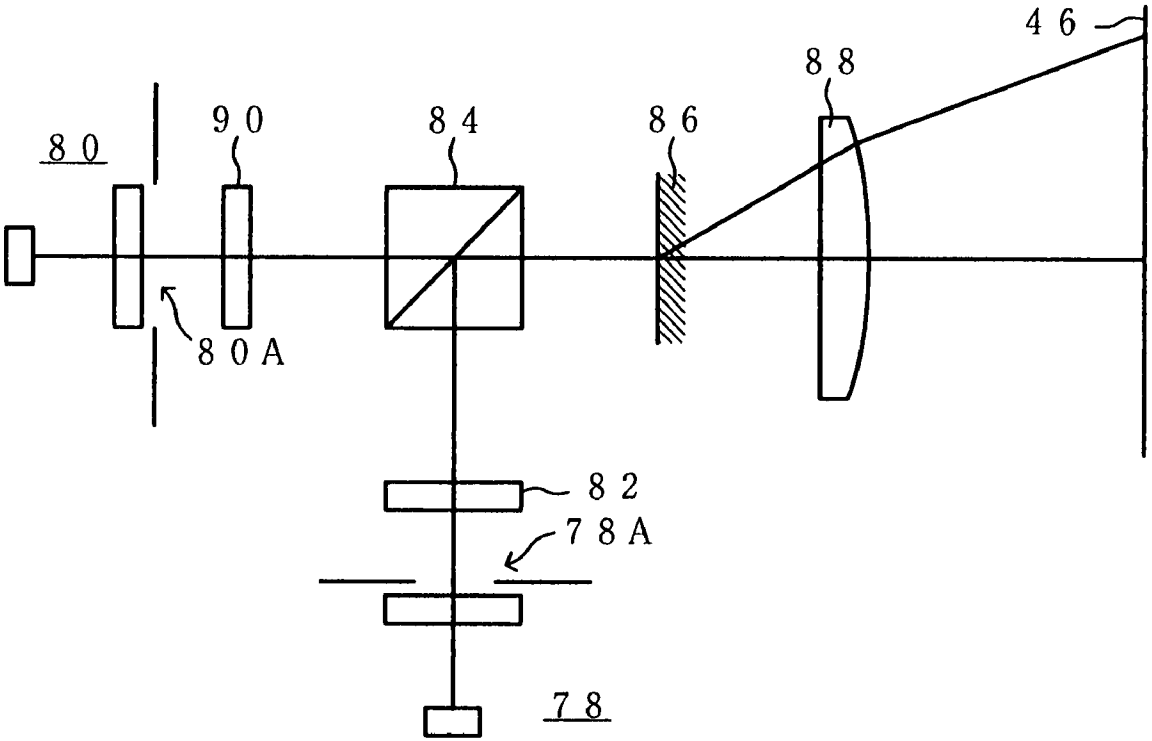

FIG. 7A is a view showing a structure of an optical system in the laser scanning device 12 relating to the third exemplary embodiment.

The laser scanning device 12 relating to this exemplary embodiment is equipped with an image formation laser light source 78 and a correction laser light source 80.

Laser light which is irradiated from the image formation laser light source 78 passes through an optical system 82, such as a collimator lens, a cylindrical lens and the like, is reflected by a half-mirror 84, is incident on a polygon mirror 86, and is scanned in the main scanning direction by rotation of the polygon mirror 86. The laser light which has been reflected by the polygon mirror 86 passes through an f-θ lens 88 and is focused onto the photosensitive drum 46.

Meanwhile, laser light which is irradiated from the correction laser light source 80, similarly to that from the image formation laser light source 78, passes through an optical system 90, such as a collimator lens, a cylindrical lens and the like, is incident on the half-mirror 84, and is transmitted through the half-mirror 84. Hence, the laser light which has passed through the half-mirror 84 follows the same optical path as the laser light irradiated from the image formation laser light source 78 and, via the polygon mirror 86 and the f-θ lens 88, is focused onto the photosensitive drum 46.

Figure 8A:
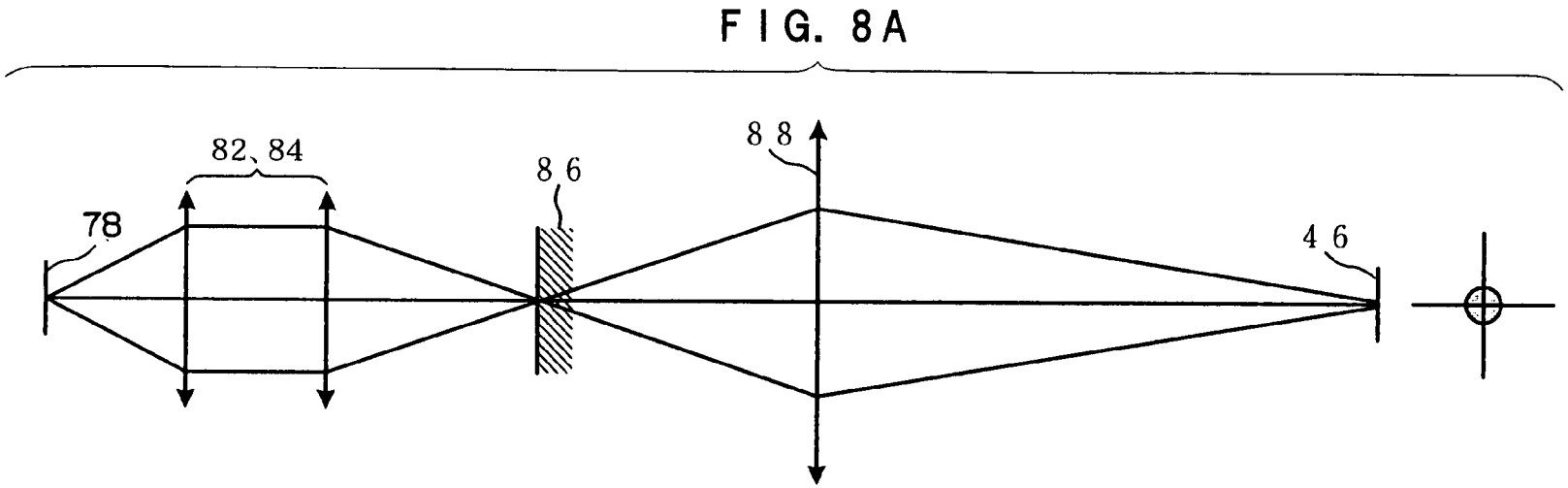
FIGS. 8A and 8B are views for describing a laser light source for image formation and a laser light source for correction in the laser scanning apparatus relating to the third exemplary embodiment.
Figure 8B:
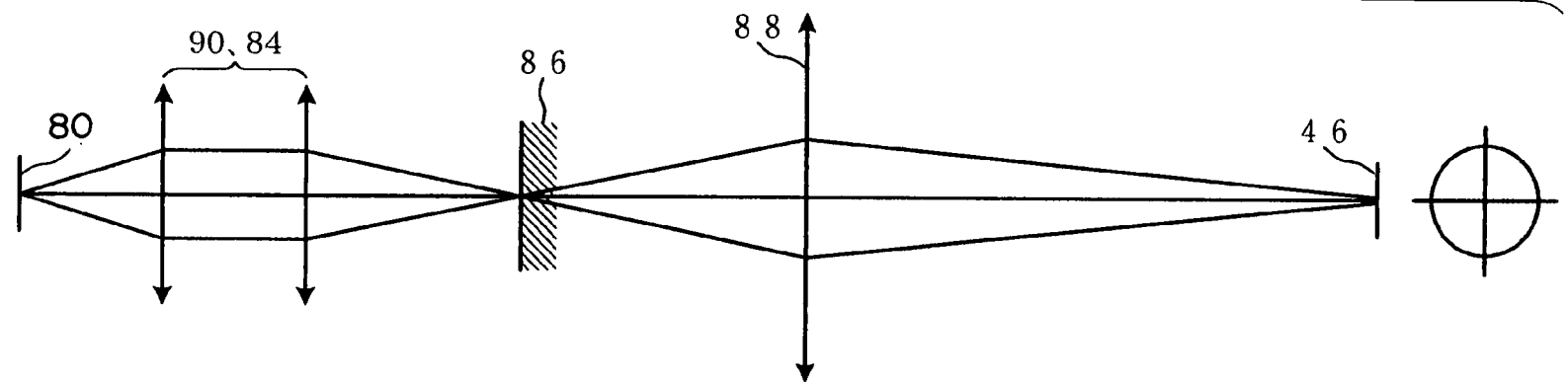

Laser light emission windows of the image formation laser light source 78 and the correction laser light source 80 are set to different sizes. Specifically, a laser light emission window 78A of the image formation laser light source 78 is set to a smaller size than a laser light emission window 80A of the correction laser light source 80. Laser light emission windows and divergence angles are inversely proportional. Therefore, as shown in FIGS. 8A and 8B, a divergence angle of laser light which is irradiated from a smaller window (i.e., the laser light that is emitted from the image formation laser light source 78) is larger than for laser light irradiated from a larger window (i.e., the laser light irradiated from the correction laser light source 80). Hence, the divergence angles are propagated by the optical systems, and a divergence angle of the laser light that is incident on the photosensitive drum 46 still corresponds in size to the laser light irradiated from the image formation laser light source 78. Furthermore, although the laser light is magnified by an overall magnification ratio of the optical systems, because the laser light irradiated from the image formation laser light source 78 and the laser light irradiated from the correction laser light source 80 are transmitted by matching optical systems (including same optical elements and sharing same optical path), a magnitude relationship of the divergence angles is maintained. Thus, the laser light with the larger divergence angle has a smaller spot diameter, and the laser light with a smaller divergence angle has a larger spot diameter. Therefore, in this exemplary embodiment, as shown in FIGS. 8A and 8B, the spot diameter of the laser light that is irradiated from the correction laser light source 80 and focused onto the photosensitive drum 46 is a larger spot diameter than the spot diameter of the laser light that is irradiated from the image formation laser light source 78 and focused onto the photosensitive drum 46.

Further, in this exemplary embodiment, the image formation laser light source 78 is formed of a surface light-emission device provided with plural light-emitting elements and, as shown in FIG. 7B, plural laser lights are focused onto the photosensitive drum 46 together. Here, a surface light-emission device is used as the image formation laser light source 78 in this exemplary embodiment, but this is not a limitation; a laser light source which emits a single laser light could be used.

If the laser scanning device 12 is structured thus and light-emission of the correction laser light source 80 is controlled in place of the correction light source 26 of the first exemplary embodiment, similarly to the first exemplary embodiment, it is possible to perform correction of intra-page density irregularities.

Moreover, the laser light for performing correction of intra-page density irregularities can carry out correction even with a resolution (precision) which is low in comparison with the laser light for image formation. Therefore, because this exemplary embodiment is specified with the spot diameter that is irradiated from the correction laser light source 80 and focused onto the photosensitive drum 46 being larger than the spot diameter that is irradiated from the image formation laser light source 78 and focused onto the photosensitive drum 46, an exposure amount correction map for correcting intra-page density irregularities can be simplified.

Fourth Exemplary Embodiment

Next, a tandem color printer relating to a fourth exemplary embodiment of the present invention will be described.

In the first, second and third exemplary embodiments, light sources other than the light source for image formation are utilized for performing correction of intra-page density irregularities. The fourth exemplary embodiment, however, has structure in which a surface light-emission device is used as the light source for image formation, and some light-emitting elements of plural light-emitting elements of the surface light-emission device are utilized as the light source for intra-page density irregularity correction. Other structures are the same as in the first exemplary embodiment. Therefore, only differences will be described.

In this exemplary embodiment, of the plural light-emitting elements of the surface light-emission device, a portion of the light-emitting elements are used as the light source for intra-page density irregularity correction. However, if the light-emitting elements are simply used as the light source for intra-page density irregularity correction, a number of light-emitting elements serving as the image formation light source becomes smaller, and the advantage of using a surface light-emission device which is capable of image formation of plural lines at the same time is diminished. Therefore, this exemplary embodiment has a structure in which a number of light sources, of the plural light-emitting elements of the surface light-emission device, to be used for intra-page density irregularity correction can be set to be small.

More specifically, the possibility of altering spot diameters that are focused onto the photosensitive drum 46 via matching optical systems by varying the sizes of laser emission windows, as has been described for the third exemplary embodiment, is utilized. In this exemplary embodiment, a size of the laser emission windows of the light-emitting elements which, of the plural light-emitting elements of the surface light-emission device, are used for intra-page density irregularity correction is made larger than a size of the laser emission windows of the light-emitting elements that are used for image formation. In other words, characteristics of the plural light-emitting elements of the surface light-emission device are set to different characteristics for the light-emitting elements which are used in image formation and the light-emitting elements which are used in intra-page density irregularity correction.

Figure 9A:
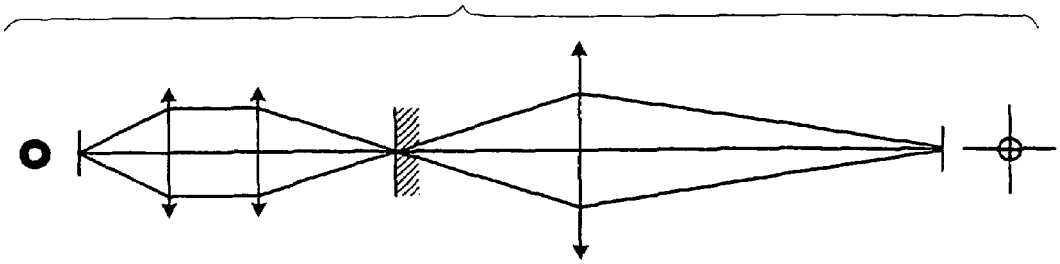
FIGS. 9A, 9B and 9C are views for describing laser light sources in a laser scanning apparatus relating to a fourth exemplary embodiment of the present invention.
Figure 9B:
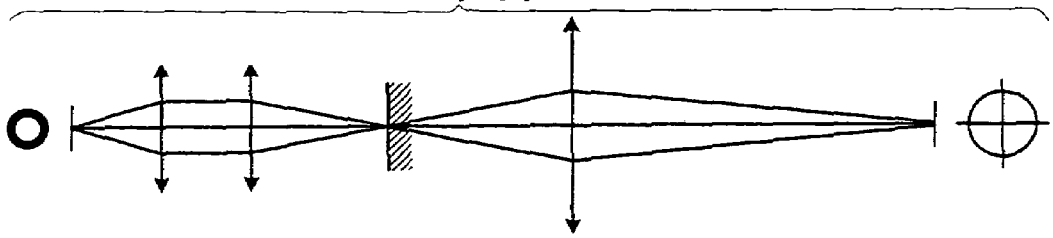

In this exemplary embodiment, as shown in FIGS. 9A and 9B, laser light that is irradiated through a smaller laser emission window (FIG. 9A) has a larger divergence angle, and a spot diameter that is focused on the photosensitive drum 46 is smaller. Laser light that is irradiated through a larger laser emission window (FIG. 9B) has a smaller divergence angle, and a spot diameter that is focused on the photosensitive drum 46 is larger. Accordingly, of the plural light-emitting elements of the surface light-emission device, characteristics of light-emitting elements that are used in intra-page density irregularity correction are assigned to the light-emitting elements with a larger laser emission window than the light-emitting elements of the other size of laser emission window. As a result, large spot diameters are formed on the photosensitive drum 46. As a result, it is possible to keep a number of light-emitting elements to be used in intra-page density irregularity correction to a minimum.

Figure 10:
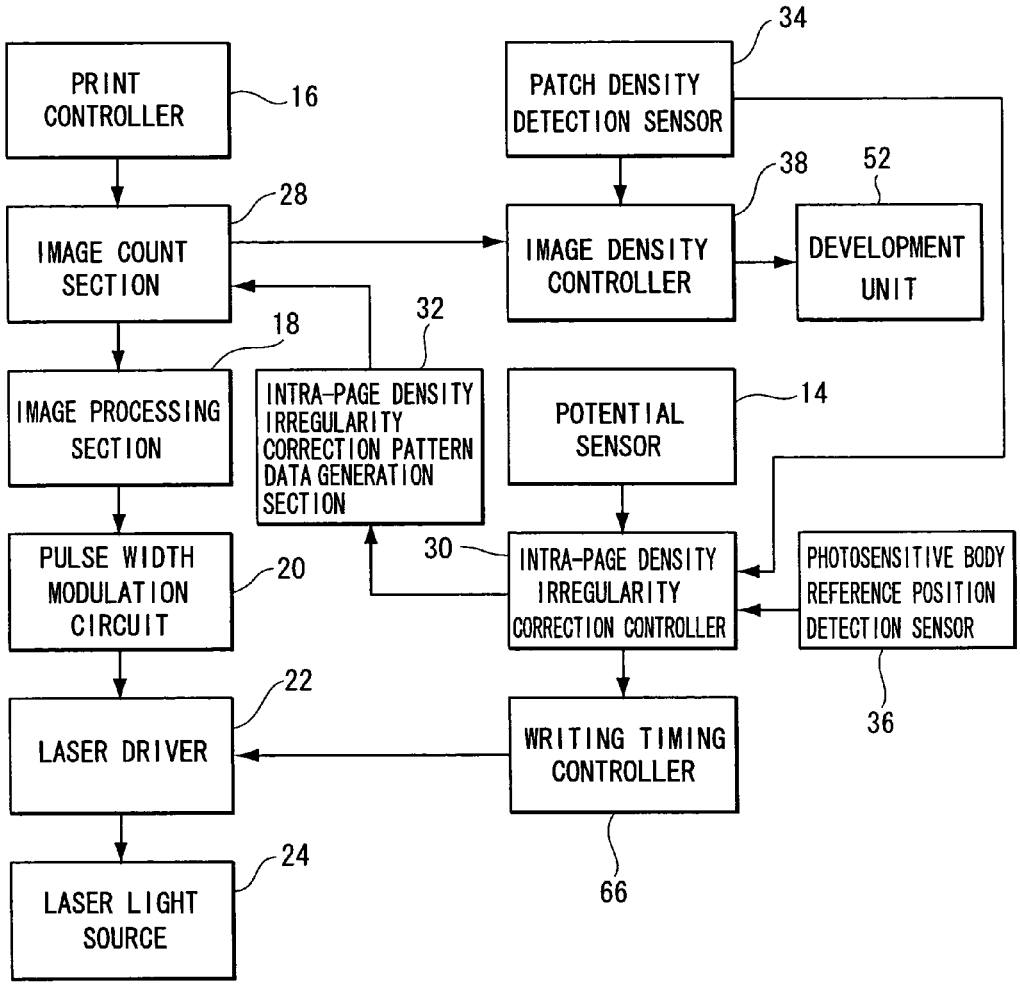
FIG. 10 is a diagram showing structure of a control system of a tandem color printer relating to the fourth exemplary embodiment.

FIG. 10 is a diagram showing structure of a control system of the tandem color printer relating to the fourth exemplary embodiment of the present invention.

In the first, second and third exemplary embodiments, the light source for correction is provided separately from the laser light source 24, and illumination of the correction light source is controlled by the correction light source driver 68. In this exemplary embodiment however, a surface light-emission device is used as the image formation laser light source, and a portion of the light-emitting elements of the surface light-emission device are used as the correction light source. Therefore, as shown in FIG. 10, the correction light source driver 68 and the correction light source 26 according to the first exemplary embodiment are omitted from the structure, and illumination control of the light-emitting elements for image formation and the light-emitting elements for correction is implemented by the laser driver 22.

That is, the writing timing controller 66 controls illumination of the laser light source 24, which is structured by the surface light-emission device, by controlling the laser driver 22 on the basis of an exposure amount map, which the intra-page density irregularity correction controller 30 calculates for correcting intra-page density irregularities, and of detection results from the photosensitive body reference position detection sensor 36.

Figure 9C:
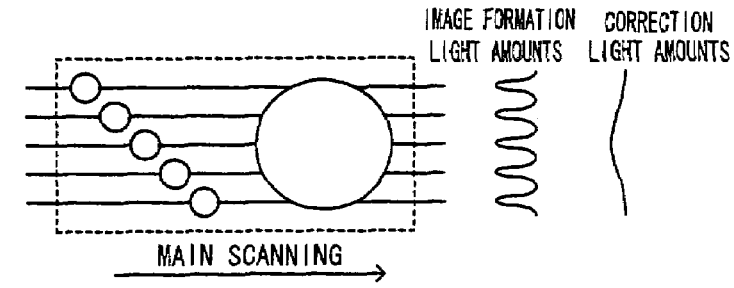

With such a structure, as shown in FIG. 9C, image formation can be carried out by laser lights irradiated from the plural light-emitting elements of the laser light source 24 for image formation (the small spot diameters in FIG. 9C), and intra-page density irregularity correction can be implemented by laser lights with larger spot diameters than the image-forming laser lights.

Thus, the spot diameter of a laser light which carries out intra-page density irregularity correction is set to a larger spot diameter than laser lights for image formation. Therefore, a number of light-emitting elements, of the plural light-emitting elements of the surface light-emission device, to be used for intra-page density irregularity correction can be kept to a minimum.

Similarly to each of the earlier described exemplary embodiments, the light-emitting elements for correction in the fourth exemplary embodiment may correct variations in potential or density of the photosensitive drum 46 continuously or stepwise over a full turn of the photosensitive drum 46.

The foregoing description of the exemplary embodiments of the present invention has been provided for the purpose of illustration and description. It is not intended to be exhaustive or to limit the invention to the precise form disclosed herein. Obviously, many modifications and variations will be apparent to a practitioner skilled in the art. The exemplary embodiments were chosen and described in order to best explain the principles of the invention and its practical applications, thereby enabling others skilled in the art to understand the invention according to various embodiments and with various modifications as are suited to the particular use contemplated. It is intended that the scope of the invention be defined by the following claims and their equivalents.

What is claimed is:

1. An image formation apparatus comprising:

an imaging light source that outputs light modulated in accordance with image data representing an image;

a photosensitive body at which an electrostatic latent image is formed by the light output from the imaging light source;

a correction light source that is provided separately from the imaging light source, and that outputs light toward the photosensitive body to correct variations in potential on the photosensitive body or irregularities in density distribution of an image, the image being formed in accordance with the electrostatic latent image that is formed on the photosensitive body by the imaging light source;

a detector that detects at least one of the potential on the photosensitive body and the density distribution of the image that has been formed;

a controller that controls the correction light source on the basis of detection results from the detector such that at least one of the potential on the photosensitive body and the density distribution of an image to be formed is substantially uniform; and a reference position detector that detects a reference position of the photosensitive body, wherein the controller controls the correction light source on the basis of detection results from the detector and the reference position detector.

2. The image formation apparatus of claim 1, wherein the correction light source exposes the photosensitive body with a spot diameter of a different size from a spot diameter that is output from the imaging light source and focused onto the photosensitive body.

3. The image formation apparatus of claim 2, wherein the spot diameter that is output from the correction light source and focused onto the photosensitive body is larger than the spot diameter that is output from the imaging light source and focused onto the photosensitive body.

4. The image formation apparatus of claim 1, wherein the imaging light source and the correction light source are disposed such that the photosensitive body is exposed with light output from the imaging light source subsequent to the photosensitive body being exposed with light output from the correction light source.

5. The image formation apparatus of claim 1, wherein the correction light source comprises a plurality of LEDs.

6. The image formation apparatus of claim 1, further comprising a charge removal light source that eliminates charge on the photosensitive body, wherein the correction light source comprises:

an optical sheet bus which guides a portion of light of the charge removal light source, and a light amount modulator which modulates a light amount of the light that is guided in the optical sheet bus, and the controller controls the light amount modulator on the basis of detection results from the detector.

7. The image formation apparatus of claim 6, further comprising a reference position detector that detects a reference position of the photosensitive body, wherein the controller controls the correction light source on the basis of detection results from the detector and the reference position detector.

8. The image formation apparatus of claim 1, further comprising an exposure apparatus at which the imaging light source is disposed, wherein the correction light source is disposed in the exposure apparatus together with the imaging light source, and comprises a light-guide portion for guiding light to an optical path of the imaging light source, and exposes the photosensitive body with the light-guide portion via an optical system which includes a portion of the optical path of the imaging light source.

9. The image formation apparatus of claim 8, wherein the imaging light source and the correction light source comprise laser light sources, and are structured such that a size of a laser light emission window of the correction light source is larger than a laser light emission window of the imaging light source.

10. The image formation apparatus of claim 1, wherein the photosensitive body comprises one of a photosensitive body drum and a continuous photosensitive body belt, and the correction light source corrects irregularities in one of the potential and density distribution on the photosensitive body at least one of continuously and stepwise over a full turn of the one of the photosensitive body drum and the photosensitive body belt.

11. An image formation apparatus comprising a surface light-emission device for image formation that includes a plurality of light-emitting elements that emit laser light, wherein the surface light-emission device comprises:

a plurality of light-emitting elements for imaging that emits laser light modulated in accordance with image data representing an image; and at least one light-emitting element for correction that is provided for correcting irregularities in potential or density on a photosensitive body that is exposed by the light emitted from the light-emitting elements for imaging, the at least one light-emitting element for correction being structured with a size of a laser light emission window being larger than a laser light emission window of the light-emitting elements for imaging.

12. The image formation apparatus of claim 11, further comprising:

a detector that detects at least one of the potential on the photosensitive body and a density distribution that has been formed; and a controller that controls the at least one light-emitting element for correction on the basis of detection results from the detector such that at least one of the potential and the density distribution on the photosensitive body is substantially uniform.

13. The image formation apparatus of claim 12, further comprising a reference position detector that detects a reference position of the photosensitive body, wherein the controller controls the at least one light-emitting element for correction on the basis of detection results from the detector and the reference position detector.

14. The image formation apparatus of claim 11, wherein the photosensitive body comprises one of a photosensitive body drum and a continuous photosensitive body belt, and the at least one light-emitting element for correction corrects irregularities in one of potential and density on the photosensitive body at least one of continuously and stepwise over one of a full turn of the photosensitive body drum and a full turn of the photosensitive body belt.

15. An image formation apparatus comprising:

an imaging light source that outputs light modulated in accordance with image data representing an image;

a photosensitive body at which an electrostatic latent image is formed by the light output from the imaging light source;

a correction light source that is provided separately from the imaging light source, and that outputs light toward the photosensitive body to correct variations in potential on the photosensitive body or irregularities in density distribution of an image, the image being formed in accordance with the electrostatic latent image that is formed on the photosensitive body by the imaging light source;

a detector that detects at least one of the potential on the photosensitive body and the density distribution of the image that has been formed;

a controller that controls the correction light source on the basis of detection results from the detector such that at least one of the potential on the photosensitive body and the density distribution of an image to be formed is substantially uniform; and a charge removal light source that eliminates charge on the photosensitive body, wherein the correction light source comprises:

an optical sheet bus which guides a portion of light of the charge removal light source, and a light amount modulator which modulates a light amount of the light that is guided in the optical sheet bus, and the controller controls the light amount modulator on the basis of detection results from the detector.

16. An image formation apparatus comprising:

an imaging light source that outputs light modulated in accordance with image data representing an image;

a photosensitive body at which an electrostatic latent image is formed by the light output from the imaging light source; and a correction light source that is provided separately from the imaging light source, and that outputs light toward the photosensitive body to correct variations in potential on the photosensitive body or irregularities in density distribution of an image, the image being formed in accordance with the electrostatic latent image that is formed on the photosensitive body by the imaging light source;

an exposure apparatus at which the imaging light source is disposed, wherein the correction light source is disposed in the exposure apparatus together with the imaging light source, and comprises a light-guide portion for guiding light to an optical path of the imaging light source, and exposes the photosensitive body with the light-guide portion via an optical system which includes a portion of the optical path of the imaging light source; and wherein the imaging light source and the correction light source comprise laser light sources, and are structured such that a size of a laser light emission window of the correction light source is larger than a laser light emission window of the imaging light source.

* * * * *